US005799354A

United States Patent [19]

Amir

[11] Patent Number: 5,799,354

[45] Date of Patent: Sep. 1, 1998

[54] TOOTHBRUSH

[76] Inventor: Ehud Amir, 18 Lylienblum Street, Tel Aviv, Israel

[21] Appl. No.: 806,718

[22] Filed: Feb. 27, 1997

[51] Int. Cl.[6] ..... A46B 9/04

[52] U.S. Cl. ..... 15/167.1; 15/201

[58] Field of Search ..... 15/167.1, 17.2, 15/201

[56] References Cited

U.S. PATENT DOCUMENTS

| | | | |
|---|---|---|---|
| 2,796,620 | 6/1957 | Bressler | 15/201 |
| 5,228,466 | 7/1993 | Klinkhammer | 15/167.1 |
| 5,269,038 | 12/1993 | Bradley | 15/167.1 |
| 5,483,722 | 1/1996 | Scheier et al. | 15/201 |

*Primary Examiner*—Terrence Till

[57] ABSTRACT

A rocker toothbrush is disclosed wherein the brushhead includes three bristle tuft bundles, each on a separate, elongated base. The middle bundle is elastically hinged to the two side bundles, which, in turn are hinged to the brushhead. A force applied to the middle bundle, during normal use, causes the two side bundles to turn in the direction toward the middle bundle.

4 Claims, 1 Drawing Sheet

TOOTHBRUSH

BACKGROUND OF THE INVENTION

The present invention relates to toothbrushes and more particularly to toothbrushes with more than one bristle tuft bundles which are adapted to perform different relative movements during use thereof.

There are known in the art of toothbrushes a great many of improvements, all striving to achieve the goal of attaining a movement of the bristles in a direction perpendicular to the tangential direction of the teeth during and generated by normal use of the brush.

One example of such design is disclosed in U.S. Pat. No. 5,269,038 dates Dec. 14, 1993, relating to "Rocker Toothbrush". However, it has been proven that, while the concept of providing separate hinged bristle-carrying pads, is in fact sound—the particular arrangement proposed failed to achieve its goal.

OBJECT AND SUMMARY OF THE INVENTION

It is therefore the prime object of the invention to provide a toothbrush wherein a non-longitudinal movement of the bristles is attained during the, and generated by the normal longitudinal movement of the brush over the teeth in a more affective way. Thus provided according to the invention is a toothbrush having a handle and a brush head. The brush head comprising two side and one central bristle tuft bundles, each mounted to a respective separate base. Each of the side bases being mounted to the brush head by an elongated, flexible hinge extending in the axial direction of the handle; and the central base is hingedly connected to the bases of the side bundles, so that under a force applied against the central bristles tuft, the bases of the side bundles pivot one in the direction of the other, and resume their initial position when the central bundle is relieved from said force.

The brush head with the pivotable bases is preferably integrally made of an elastic plastic material.

BRIEF DESCRIPTION OF THE DRAWINGS

The above and further features and advantages of the invention will become apparent upon consideration of the following detailed description of a preferred embodiment of the invention taken in conjunction with the accompanying drawings, wherein.

DETAILED DESCRIPTION OF THE PREFERRED EMBODIMENT

Figure 1:
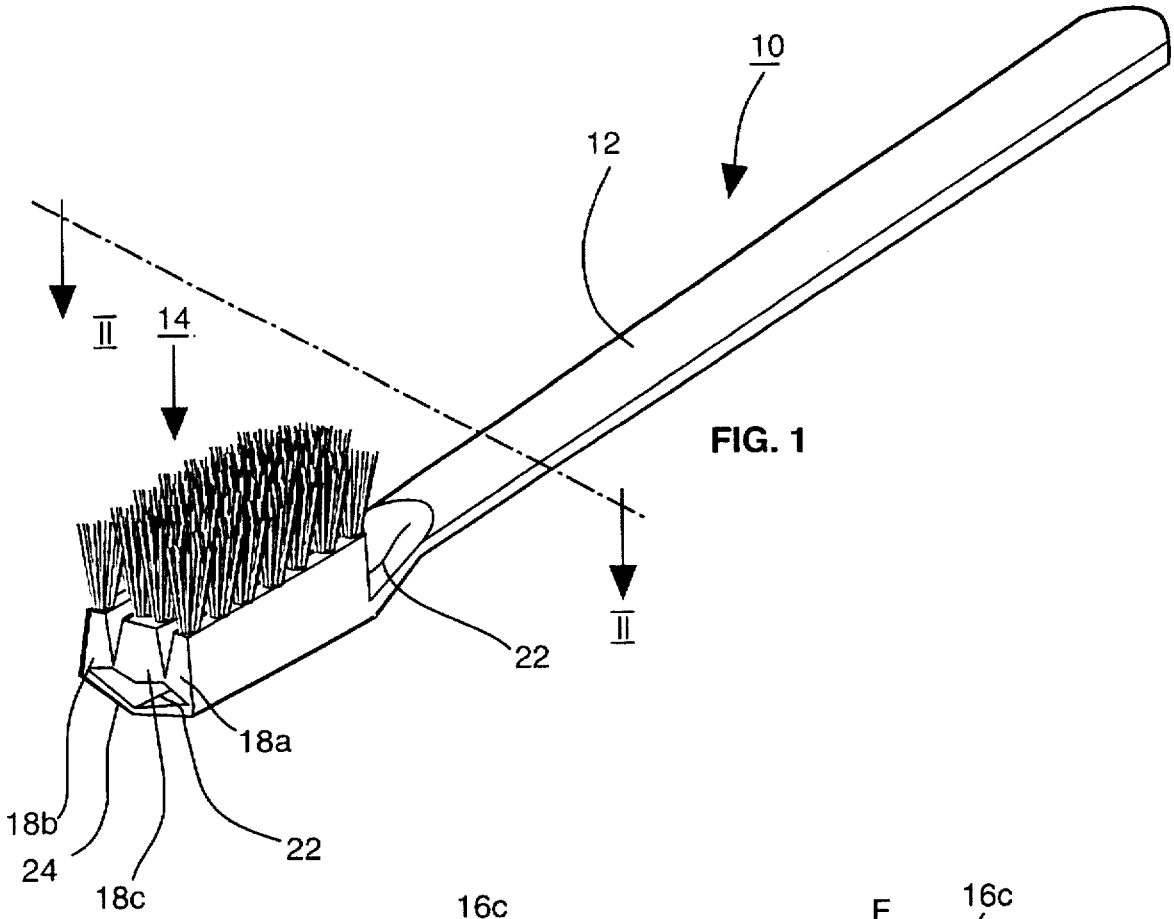
FIG. 1 is a three-dimensional view of a toothbrush incorporating the improvement according to the present invention.
Figure 2:
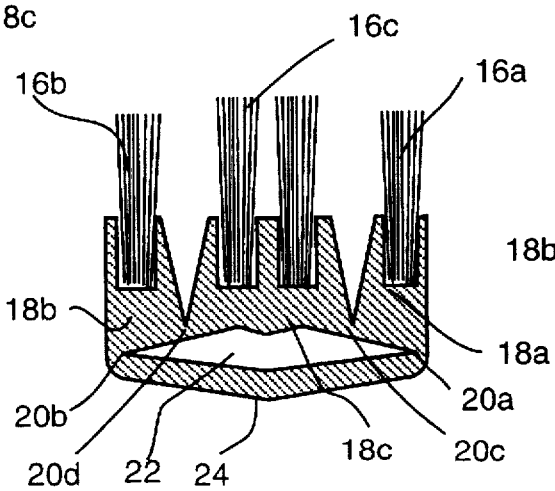
FIG. 2 is a section taken along line II—II of FIG. 1.

Referring to FIG. 1, there is shown a toothbrush 10 with handle 12 and head 14.

The head 14 comprises a pair of side-bristles tuft bundles **16*a* and 16*b*, respectively, mounted to separate bases 18*a* and 18*b*, and a central bundle 16c mounted to base 18*c***.

As shown, the bristle tuft **16*c* is preferably longer than the side bundles 16*a* and 16*b***.

The bases **18*a* and 18*b* are each connected along an integral flexible elongated hinge 20*a* and 20*b*, to the respective outer sides of the head 14 so that a hollow space 22 is formed, extending under the bases 18.bridged by profiled concave web 24** in any suitable manner.

The central base **18*c* is similarly connected to the bases 18*a* and 18*b* by hinges 20*c* and 20*d***, respectively.

The composite structure of the bases **18*a*, 18*b* and 18*c*, with the bores for mounting the bristles tufts 16*a*, 16*b* and 16*c*, lends itself to be integrally formed with the handle 12, of the same material such as Nylon, the head being more elastic, while the handle 12**—of a more compact and rigid properties, as known per-se in the art.

Figure 3:
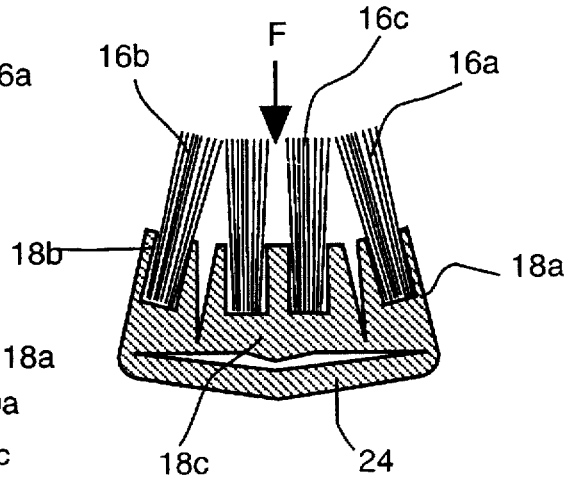
FIG. 3 illustrates the operation of the toothbrush during use thereof.

As will be now readily understood, with reference to FIG. 3, under a normally directed force, denoted by the arrow F applied to the bristle **16*c* by the very use of the toothbrush against the surface of the teeth (not shown), the bases 18*a* and 18*b* will pivot and turn each in the direction of the central bristle 16*c*. The hollow space 22** becomes almost closed.

Consequently, a transverse movement of the side bristles will bring about a brushing action of the teeth surfaces in a direction perpendicular to the tangential direction of the brush during the normal toothbrushing movement.

As already mentioned, this transverse brushing movement of the bristle is most favorable and recommended by the dental professionals.

Thus established is a toothbrush which is most simple, straightforward and of an integral structure, which is therefore low-cost and simple to produce, achieving better and more healthy toothbrushing for which so many efforts have heretofore been made.

Those skilled in the art will readily appreciate that numerous changes, modifications and variations may be applied to the invention as hereinbefore exemplified without departing from the scope of the invention as defined in and by the appended claims.

What is claimed is:

1. A toothbrush having a handle and a brush head, the brush head comprising two side, and one central bristle tuft bundles, each mounted to a respective separate base, each of the side bases being mounted to the brush head by an elongated, flexible hinge extending in the axial direction of the handle, and the central base being hingedly connected to the bases of the side bundles, so that under a force applied against the central bristles tuft, the bases of the side bundles pivot one in the direction of the other, and resume their initial position when the central bundle is relieved from said force.

2. The toothbrush as claimed in claim 1 wherein the said hinges of the side-bases extent along the two outer sides of the brush head, respectively.

3. The toothbrush as claimed in claim 2 wherein the bristle of the central bundle is longer than that of the two side bundles.

4. The toothbrush as claimed in claim 3 wherein the handle, brush head and the said bases are integrally formed of an alastic plastic material.

* * * * *